US009462889B2

(12) United States Patent
Piretti

(10) Patent No.: US 9,462,889 B2
(45) Date of Patent: Oct. 11, 2016

(54) CHAIR WITH A SEAT AND BACKREST MOVABLE IN A SYNCHRONIZED WAY

(71) Applicant: PRO-CORD S.p.A., Bologna (IT)

(72) Inventor: Alessandro Piretti, Bologna (IT)

(73) Assignee: PRO-CORD S.P.A., Bologna (IT)

( * ) Notice: Subject to any disclaimer, the term of this patent is extended or adjusted under 35 U.S.C. 154(b) by 23 days.

(21) Appl. No.: 14/617,715

(22) Filed: Feb. 9, 2015

(65) Prior Publication Data

US 2015/0223605 A1 Aug. 13, 2015

(30) Foreign Application Priority Data

Feb. 13, 2014 (IT) ..... TO2014A0121

(51) Int. Cl.
*A47C 1/00* (2006.01)
*A47C 1/032* (2006.01)
*A47C 7/00* (2006.01)

(52) U.S. Cl.
CPC ..... *A47C 1/03261* (2013.01); *A47C 1/03255* (2013.01); *A47C 1/03277* (2013.01); *A47C 1/03294* (2013.01); *A47C 7/006* (2013.01)

(58) Field of Classification Search
CPC ..... A47C 1/03261; A47C 1/03255; A47C 1/03277; A47C 1/03294; A47C 7/445
USPC ..... 297/295, 299, 300.1, 341, 342, 296, 297/297, 344.1
See application file for complete search history.

(56) References Cited

U.S. PATENT DOCUMENTS 4,391,453 A * 7/1983 Glaser ..... B62B 7/06 280/47.4
4,962,962 A 10/1990 Machate et al.
5,486,035 A * 1/1996 Koepke ..... A47C 31/126 297/300.1
8,777,312 B2 * 7/2014 Diffrient ..... A47C 1/03255 297/300.1
2008/0169693 A1 * 7/2008 Becker ..... A47C 7/28 297/299
2012/0146377 A1 6/2012 Diffrient

FOREIGN PATENT DOCUMENTS

EP 1057431 A1 12/2000
EP 1785070 A1 5/2007

OTHER PUBLICATIONS

Italian Search Report and Written Opinion dated Jul. 22, 2014 for Application No. TO2014A000121.

* cited by examiner

*Primary Examiner* — Laurie K Cranmer
(74) *Attorney, Agent, or Firm* — Patterson & Sheridan, LLP

(57) ABSTRACT

A chair comprising: a base structure having two lateral uprights fixed relative to the base structure, a backrest comprising a support panel, two connecting portions fixed to respective side uprights of the base structure, and two hinge portions located between the support panel and said connecting portions, wherein said hinge portions allow a backward inclination of the support panel about a transverse axis (A) under a backward thrust applied by the user, a seat panel connected to the base structure by at least one guide, which allows a movement of the seat panel with respect to the base structure in a longitudinal direction (B), and at least one elastic connecting element fixed to the support panel and to the seat panel and configured to move the seat panel along said longitudinal direction (B) as a result of the oscillation of the support panel about said transverse axis (A).

8 Claims, 6 Drawing Sheets

CHAIR WITH A SEAT AND BACKREST MOVABLE IN A SYNCHRONIZED WAY

CROSS-REFERENCE TO RELATED APPLICATIONS

This application claims benefit of Italian patent application number TO2014A000121, filed Feb. 14, 2014, which is herein incorporated by reference.

BACKGROUND OF THE INVENTION

1. Field of the Invention

The present invention relates to a chair with a seat and backrest movable in a synchronized way.

More precisely, the invention relates to a chair comprising a base structure, a backrest connected in a pivoting manner to the base structure and capable of being inclined backwards under a backward thrust applied by the user and a seat movable relative to the base structure in a manner synchronized with the inclination movement of the backrest.

2. Description of Prior Art

In the prior art, many solutions are known of chairs equipped with a synchronized movement of the seat and backrest.

Generally, the known solutions comprise lever mechanisms, which connect the backrest to the seat in an articulated manner, so that a backward pivoting movement of the backrest corresponds to a forward movement of the seat. The known mechanisms are generally also provided with elastic elements for elastically recalling the backrest and the seat into a resting position.

The mechanisms for the synchronized movement of the seat and the backrest are usually complex and expensive and involve a considerable increase in the cost of the chair.

SUMMARY OF THE INVENTION

The present invention aims to provide a chair with a seat and backrest movable in a synchronized manner that is simple, economical and formed by a reduced number of components.

According to the present invention, this object is achieved by a chair comprising:

- a base structure having two lateral uprights fixed relative to the base structure,
- a backrest comprising a support panel, two connecting portions fixed to respective lateral uprights of the base structure, and two hinge portions located between the support panel and said connecting portions, wherein said hinge portions allow a backward inclination of the support panel about a transverse axis under a backward thrust applied by the user,
- a seat panel connected to the base structure by at least one guide which allows a movement of the seat panel with respect to the base structure in a longitudinal direction; and
- at least one elastic connecting element fixed to the support panel and to the seat panel and configured to move the seat panel along said longitudinal direction as a result of the oscillation of the support panel about said transverse axis.

The claims form an integral part of the disclosure given in relation to the invention.

BRIEF DESCRIPTION OF THE DRAWINGS

The present invention will now be described in detail with reference to the attached drawings, given purely by way of non-limiting example, in which.

DETAILED DESCRIPTION

Figure 1:
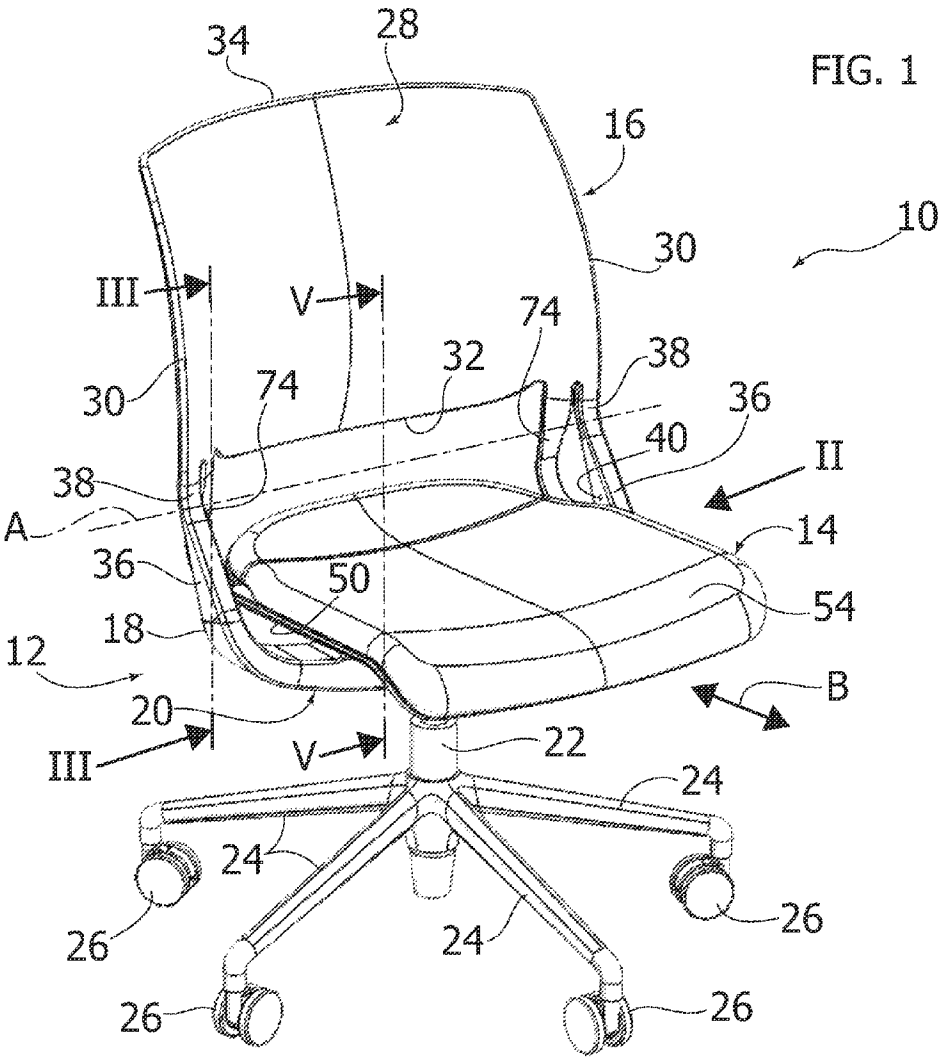
FIG. 1 is a perspective view of a chair according to the present invention.

With reference to the Figures, numeral 10 indicates a chair according to the present invention. The chair 10 comprises a base structure 12 carrying a seat 14 and a backrest 16. The base structure 12 comprises two lateral uprights 18 located on opposite sides relative to the seat 14 and extending upwardly relative to the seat 14. In the illustrated example, the lateral uprights 18 are formed in an integral manner with the opposite ends of a cross-member 20. The cross-member 20 has a central area that extends in the transverse direction below the seat 14 and two lateral areas bent upwards, which terminate at the lateral uprights 18. The cross-member 20 is preferably formed of metallic material, for example, aluminum alloy or the like. The cross-member 20 is mounted at the upper end of a height-adjustable central column 22, of a known type in the field of office chairs. In a known manner, the central column 22 carries the cross-member 20 in a rotatable manner about a vertical axis, and is fixed to a plurality of arms 24 carrying respective pivoting wheels 26 at their outer ends.

Figure 2:
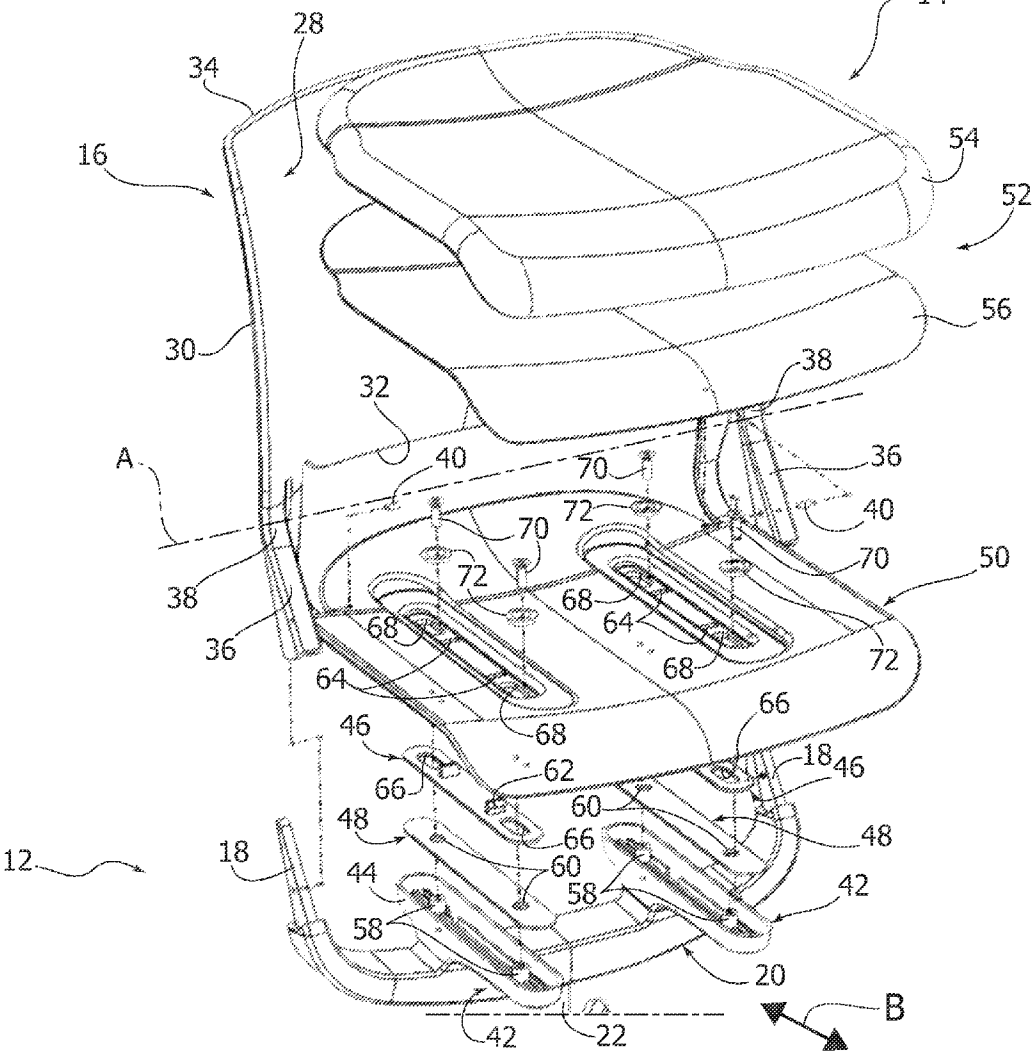
FIG. 2 is an exploded perspective view of the part indicated by the arrow II in FIG. 1.

With reference to FIGS. 1 and 2, the backrest 16 comprises a support panel 28 with an arcuate shape, having two side edges 30, a lower edge 32 and an upper edge 34. The support panel 28 is preferably made of injection-molded plastic material.

The backrest 16 comprises two connecting portions 36 fixed to respective lateral uprights 18 of the base structure 12. In the illustrated embodiment, the connecting portions 36 are hollow and receive respective lateral uprights 18 therein with shape coupling. Transverse pins 40 may be provided, inserted through aligned holes of the connecting portions 36 and of the lateral uprights 18 to prevent the connecting portions 36 becoming extracted from the lateral uprights 18.

The connecting portions 36 are connected to the support panel 28 by means of respective hinge portions 38. The hinge portions 38 are designed to allow an oscillation of the support panel 28 relative to the connecting portions 36 about a horizontal transverse axis A. According to a preferred embodiment, the hinge portions 38 and the connecting portions 36 are formed in one piece with the support panel 28. Preferably, the hinge portions 38 and the connecting portions 36 form downward extensions of the side edges 30 of the support panel 28. The hinge portions 38 are formed by two sections of flexible and elastically deformable plastic material, which define two localized flexion areas aligned on the axis A. When the hinge portions 38 are bent with respect to an undeformed position, the intrinsic elasticity of the plastic material produces an elastic force which tends to bring the hinge portions 38 back to their undeformed position.

The seat 14 is connected to the base structure 12 by means of at least one guide, which allows a movement of the seat 14 relative to the base structure 12 in a longitudinal direction indicated by the double arrow B. The direction B, along which the seat 14 is movable, is preferably straight and horizontal.

Figure 5:
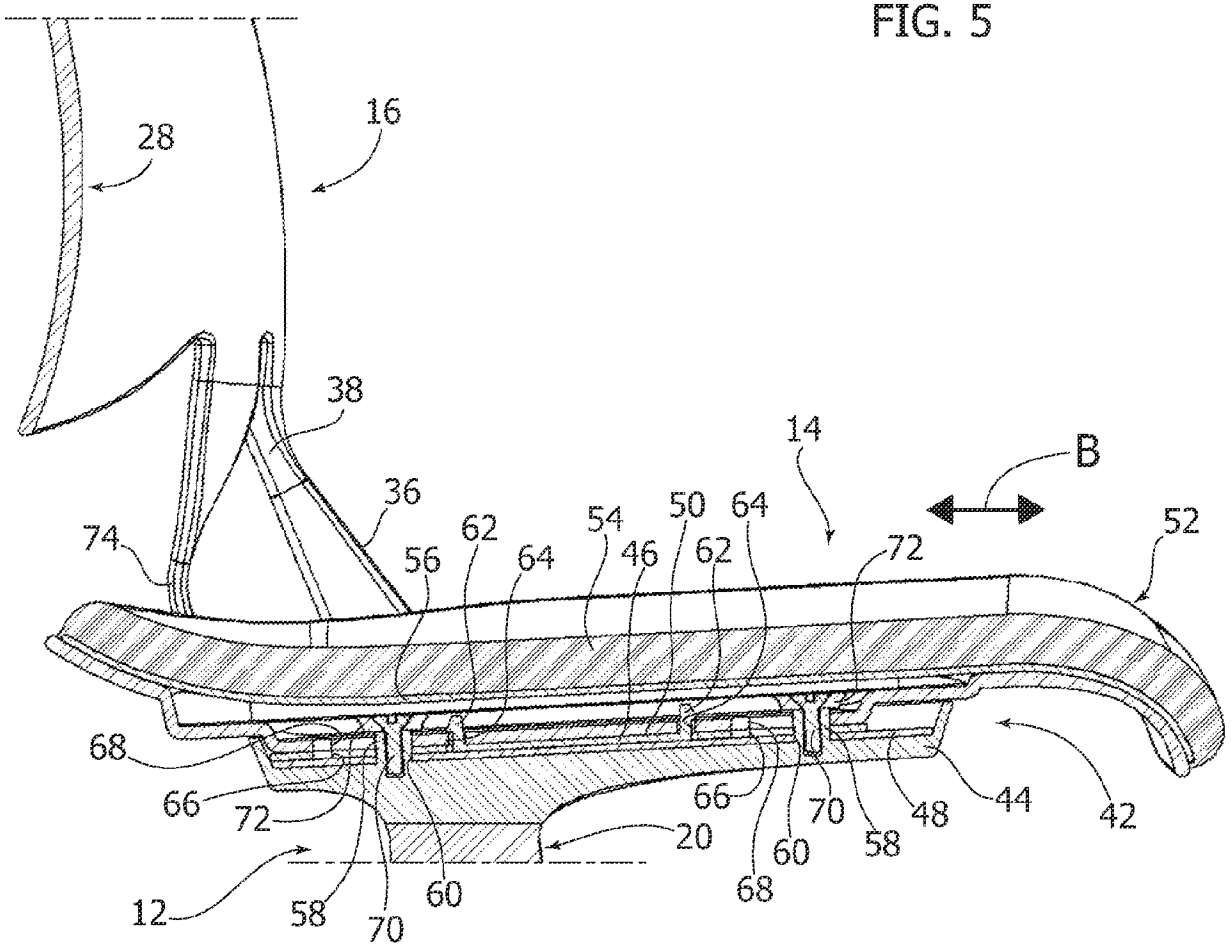
FIGS. 5 and 6 are cross-sections according to the line V-V of FIG. 1, with the backrest in the resting position and in the position of maximum backward inclination, respectively.
Figure 6:
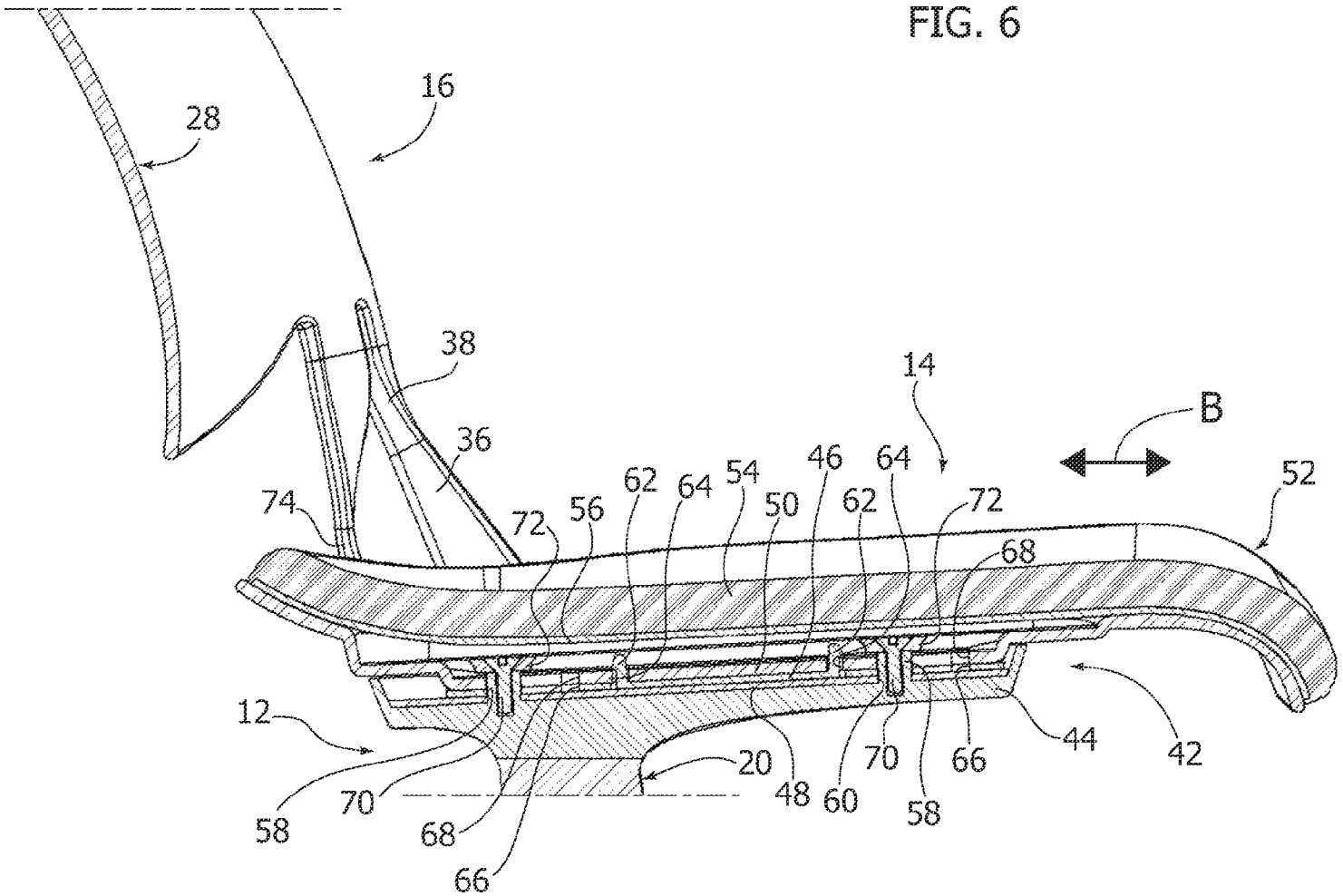

With reference to FIGS. 2, 5 and 6, the chair 10 preferably comprises two straight guides 42 parallel to each other, located between the cross-member 20 and the seat 14. Each guide 42 comprises an elongated support 44 fixed to the cross-member 20. Preferably, each support 44 has the shape of a narrow tub open at the top and elongated in the direction B. Each guide 42 comprises a slider 46 fixed to the seat 14 and a bearing element 48 fixed to the respective support 44. The slider 46 and the respective bearing element 48 have the shape of strips elongated in the B direction and have respective facing flat surfaces arranged in mutual sliding contact. Preferably, the sliders 46 and the bearing elements 48 are made of material with a low coefficient of friction, for example, Teflon®. Each slider 46 can be fixed to the seat panel 50 by a pair of teeth 62 which snap-fit within respective slots 64 of the seat panel 50.

With reference to FIG. 2, the seat 14 comprises a seat panel 50 preferably made of injection-molded plastic material. The seat 14 may also include a covering 52 applied to the upper surface of the seat panel 50. The covering 52 may include padding 54 and a support pad 56. The support pad 56 is fixed onto the upper surface of the seat panel 50.

With reference to FIGS. 2, 5 and 6, each slider 46 is equipped with a pair of slots 66 elongated in the B direction and facing corresponding slots 68 formed in the seat panel 50. Each support 44 has two fixed vertical pins 58. Each pin 58 extends through a respective hole 60 of the bearing element 48, through a respective slot 66 of the respective slider 46 and through a respective slot 68 of the seat panel 50. The engagement between the slots 66, 68 and the pins 58 allows the movement of the seat panel 50 relative to the supports 44 in the longitudinal direction B. The movement in the direction B of the seat panel 50 is limited by the length of the slots 66, 68. The pins 58 and the slots 66, 68 constitute end-stroke devices, which define an advanced position and a retracted position of the seat 14.

Screws 70 engage respective threaded holes of the vertical pins 58. The screws 70 are associated with respective washers 72 which rest on the upper edges of the respective slots 68. The screws 70 secure the seat panel 50 to the supports 44 in the vertical direction without impeding the freedom of movement of the seat 14 in the direction B.

The backrest 16 and the seat 14 are connected together by means of at least one elastic connecting element 74, configured to move the seat 14 along the longitudinal direction B as a result of the oscillation of the backrest about the axis A. In the example illustrated, two elastic connecting elements 74 are provided, laterally located in the vicinity of the respective connecting elements 36.

Each elastic connecting element 74 is formed of a strip of flexible and elastically deformable material. Each elastic connecting element 74 has an arc profile with an upper end fixed to the lower edge 32 of the support panel 28 and a lower end fixed to the seat panel 50. According to a preferred embodiment, the elastic connecting elements 74 are formed in a single piece with the support panel 28 and with the seat panel 50. Alternatively, the elastic connecting elements 74 can be separate elements fixed to the support panel 28 and to the seat panel 50 by means of any known fastening system. The elastic elements 74 could also be formed in one piece with the seat panel 50 and be fixed to the support panel 28 or, vice versa, could be in one piece with the support panel 28 and be fixed to the seat panel 50. A single elastic connecting element may also be provided positioned in a central position of the support panel 28 and the seat panel 50.

Figure 3:
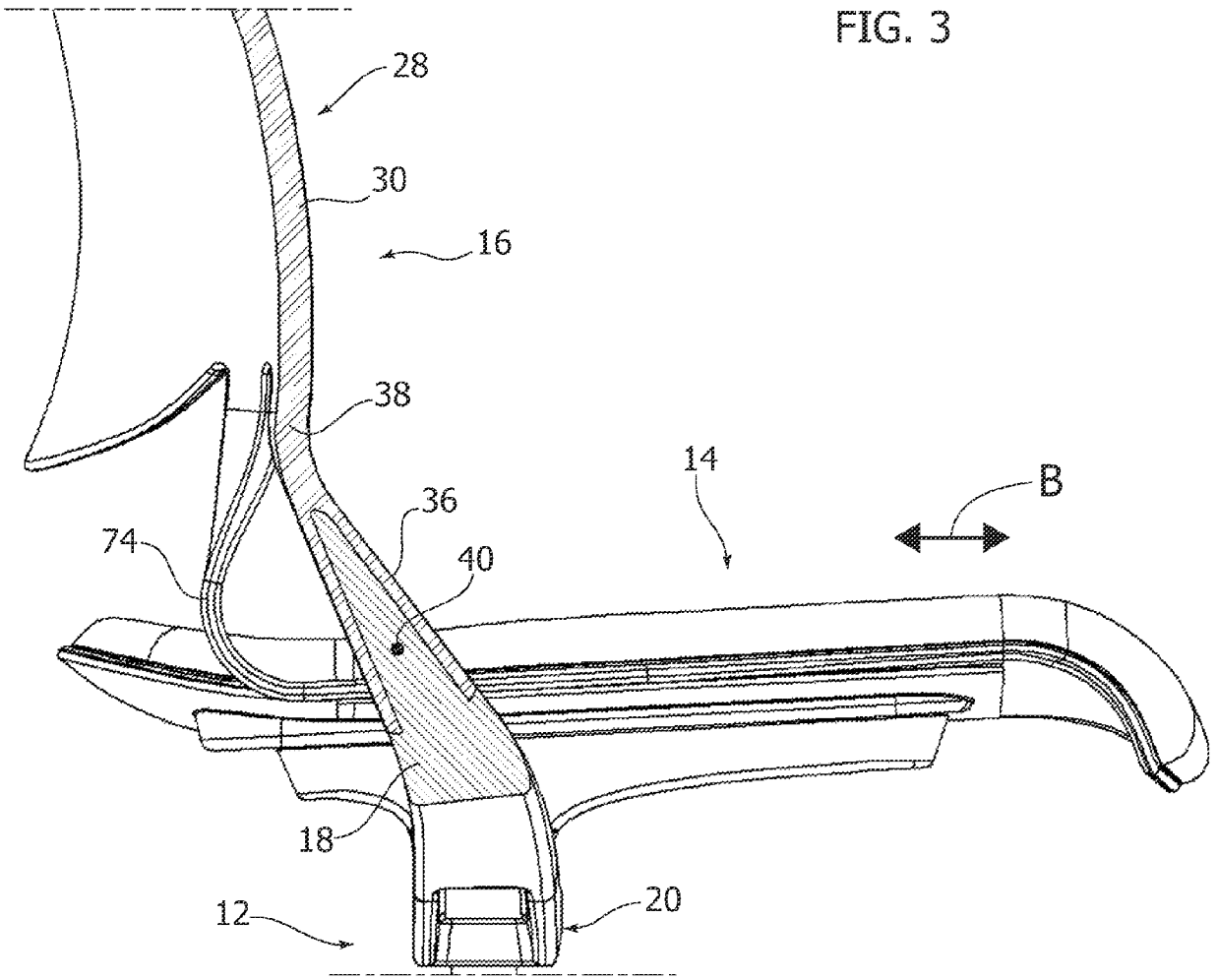
FIGS. 3 and 4 are cross-sections along the line III-III of FIG. 1, with the backrest in the resting position and in the position of maximum backward inclination, respectively.

In resting conditions, that is, without a backward thrust applied to the backrest 16, the backrest 16 and the seat 14 are in the position illustrated in FIGS. 3 and 5. The seat 14 is in a retracted position and the backrest 16 is in an upright position. When the user applies a backward thrust, the backrest panel 28 inclines backwards about the axis A, elastically deforming the hinge portions 38.

Figure 4:
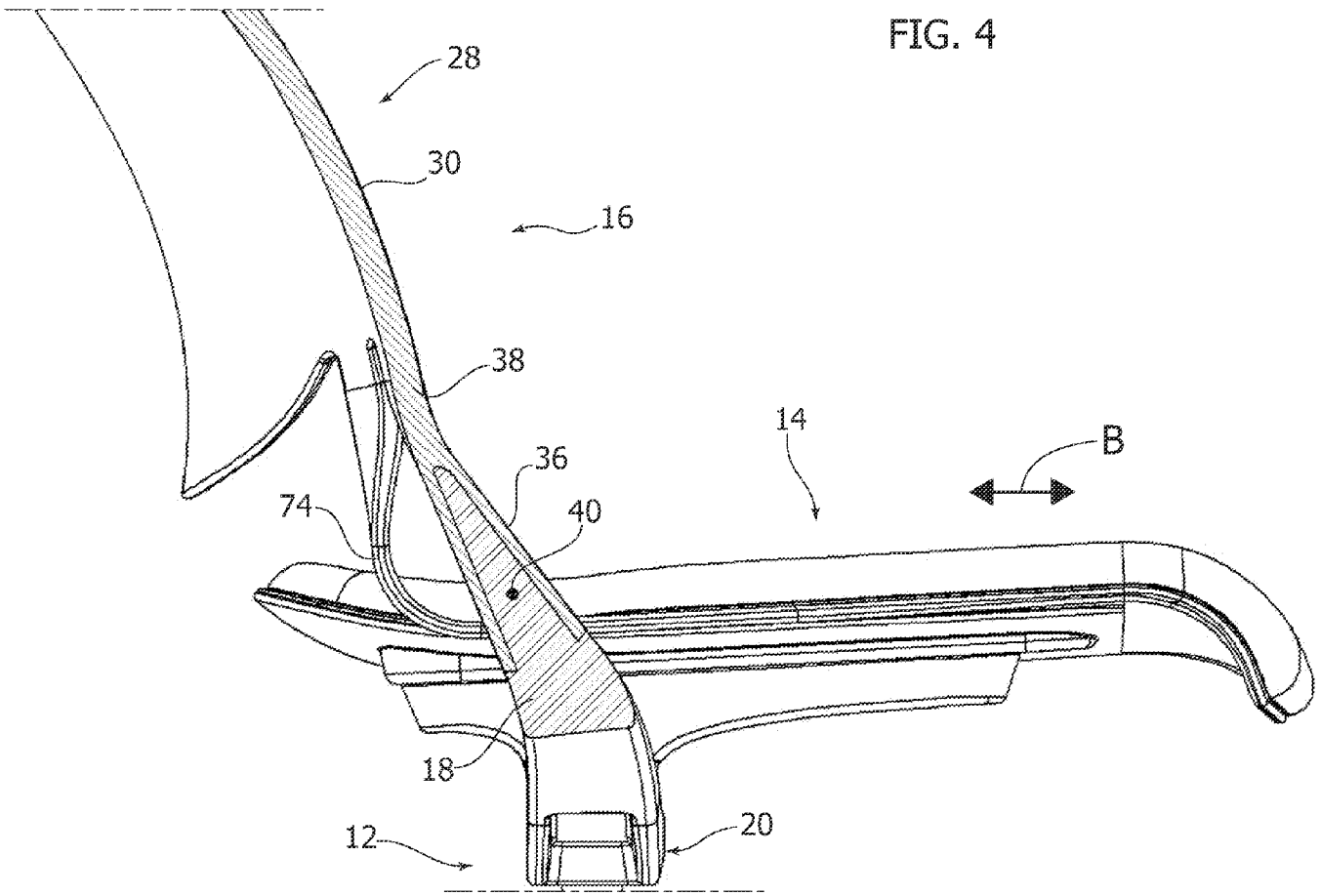

FIGS. 4 and 6 show the chair in the position of maximum backward inclination of the backrest 16. The backward inclination movement of the backrest 16 causes the forward movement of the seat 14, given that the seat 16 and the backrest 14 are interconnected to each other by the elastic connecting elements 74. In the position of maximum backward inclination of the backrest 16, the seat 14 is retained in the advanced position by the abutment between the pins 58 and the rear ends of the slots 66, 68.

The end-stroke device, which limits the forward stroke of the seat 14, also limits the backward inclination of the backrest panel 28 given that the backrest 16 is connected to the seat 14 by means of elastic connecting elements 74.

When the backward thrust on the backrest 16 ceases, the hinge portions 38 and the elastic connecting elements 74 return to their undeformed configuration and carry the backrest 16 back into the upright position and the seat 14 into the retracted position.

The movements of the seat 16 and the backrest 14 are synchronized with each other. The amplitude of these movements is designed so as to provide optimum comfort. The synchronized movements of the seat and the backrest are obtained exploiting only the elastic deformation of the materials constituting the hinge portions 38 and the elastic connecting elements 74. The torque that opposes the backward flexion of the backrest 16 is given by the sum of the elastic return torques of the hinge portions 38 and of the elastic connecting elements 74. One of the main advantages of the present invention is that articulated mechanisms are not required to provide the synchronized movement of the seat and the backrest, nor are additional elastic elements required to provide the elastic return torque of the backrest.

Of course, without prejudice to the principle of the invention, the details of construction and the embodiments may be varied widely with respect to that described and illustrated, without departing from the scope of the invention as defined by the following claims.

The invention claimed is:

1. A chair comprising:

a base structure having two lateral uprights fixed relative to the base structure;

a backrest comprising a support panel, two connecting portions fixed to respective lateral uprights of the base structure, and two hinge portions located between the support panel and said connecting portions, wherein said hinge portions allow a backward inclination of the support panel about a transverse axis under a backward thrust applied by the user, wherein said hinge portions and said connecting portions are formed in one piece with said support panel;

a seat panel connected to the base structure by at least one guide which allows a movement of the seat panel with respect to the base structure in a longitudinal direction; and at least one elastic connecting element fixed to the support panel and to the seat panel and configured to move the seat panel along said longitudinal direction as a result of the oscillation of the support panel about said transverse axis.

2. A chair according to claim 1, wherein said elastic connecting element is made of elastically deformable flexible material and has an arcuate shape with an upper end fixed to the support panel and a lower end fixed to the seat panel.

3. A chair according to claim 1, wherein said elastic connecting element is formed in one piece with either said support panel or with said seat panel.

4. A chair according to claim 1, wherein said elastic connecting element is formed in one piece with said support panel and with said seat panel.

5. A chair according to claim 1, comprising two elastic connecting elements located laterally with respect to the seat and in proximity of said side connecting portions of the backrest.

6. A chair according to claim 1, wherein said connecting portions of the backrest are hollow and receive respective lateral uprights therein with shape coupling.

7. A chair according to claim 1, wherein said at least one guide comprises a slider fixed with respect to the seat panel and a bearing element fixed with respect to said base structure, the slider and the bearing element having respective flat facing surfaces in mutual sliding contact.

8. A chair according to claim 1, wherein the base structure and the seat panel comprise an end-stroke device including at least one pin fixed with respect to said base structure and cooperating with a slot of the seat panel elongated in said longitudinal direction.

* * * * *